US008679198B2

(12) United States Patent
Bae et al.

(10) Patent No.: US 8,679,198 B2
(45) Date of Patent: Mar. 25, 2014

(54) WASHING MACHINE AND METHOD OF CONTROLLING A WASHING MACHINE

(75) Inventors: Sun Cheol Bae, Kyungsangnam-do (KR); Kyung Hoon Kim, Kyungsangnam-do (KR); Han Su Jung, Kyungsangnam-do (KR); Jae Hyeok Choi, Kyungsangnam-do (KR); Ja In Koo, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 768 days.

(21) Appl. No.: 12/466,513

(22) Filed: May 15, 2009

(65) Prior Publication Data

US 2010/0037401 A1 Feb. 18, 2010

(30) Foreign Application Priority Data

May 23, 2008 (KR) ..... 10-2008-0048186

(51) Int. Cl.
*C11D 3/00* (2006.01)

(52) U.S. Cl.
USPC ..... 8/137; 8/148; 8/158; 134/18; 134/25.1; 134/34

(58) Field of Classification Search
None
See application file for complete search history.

(56) References Cited

U.S. PATENT DOCUMENTS

| | | | | |
|---|---|---|---|---|
| 3,301,024 | A | 1/1967 | Smith | 68/12 |
| 4,782,544 | A | 11/1988 | Nystuen et al. | 8/159 |
| 5,207,764 | A | 5/1993 | Akabane et al. | |
| 5,671,494 | A | 9/1997 | Civanelli et al. | |
| 5,692,313 | A | 12/1997 | Ikeda et al. | 34/58 |
| 5,768,730 | A | 6/1998 | Matsumoto et al. | 8/159 |
| 5,887,456 | A | 3/1999 | Tanigawa et al. | 68/20 |
| 6,029,299 | A | 2/2000 | Baek et al. | 8/159 |
| 6,240,586 | B1 | 6/2001 | Joo | 8/159 |
| 6,381,791 | B1 | 5/2002 | French et al. | 8/159 |
| 6,578,225 | B2 | 6/2003 | Jönsson | 8/159 |
| 7,412,740 | B2 | 8/2008 | Park et al. | 8/159 |
| 7,478,547 | B2 | 1/2009 | Okazaki et al. | 68/12.04 |
| 7,490,490 | B2 | 2/2009 | Hirasawa et al. | 68/12.04 |
| 7,530,133 | B2 | 5/2009 | Mitts | 8/159 |
| 7,627,920 | B2 | 12/2009 | Wong et al. | 8/159 |

(Continued)

FOREIGN PATENT DOCUMENTS

| | | |
|---|---|---|
| CA | 2 360 476 C | 5/2002 |
| CN | 1966812 | 5/2007 |

(Continued)

OTHER PUBLICATIONS

European Search Report dated Sep. 9, 2009 for Application No. 09160861.2-2314.

(Continued)

*Primary Examiner* — Eric Golightly
(74) *Attorney, Agent, or Firm* — KED & Associates LLP

(57) ABSTRACT

A washing machine and a method of controlling the washing machine may be provided. The washing machine may include a drum in which laundry are provided and rotated. A laundry amount may be sensed. The drum may operate at a first speed so that a part of the laundry tumbles within the drum and another part of the laundry adheres to the drum or the drum operates at a second speed so that the laundry adheres to the drum according to the sensed laundry amount. Accordingly, at a time of a dehydration cycle, stability of the washing machine and a laundry balancing can be ensured.

15 Claims, 15 Drawing Sheets

(56) References Cited

U.S. PATENT DOCUMENTS

| | | | | |
|---|---|---|---|---|
| 2001/0052265 | A1 | 12/2001 | French et al. | 73/660 |
| 2002/0020196 | A1 | 2/2002 | Kakuda et al. | |
| 2003/0140427 | A1 | 7/2003 | Yamamoto et al. | 8/159 |
| 2005/0102766 | A1 | 5/2005 | Vande Haar et al. | 8/159 |
| 2005/0251926 | A1* | 11/2005 | Lee et al. | 8/158 |
| 2006/0005319 | A1 | 1/2006 | Park | 8/158 |
| 2006/0107299 | A1 | 5/2006 | Bartfeld et al. | 75/110 |
| 2006/0185095 | A1 | 8/2006 | Mitts | 8/158 |
| 2006/0207299 | A1* | 9/2006 | Okazaki et al. | 68/12.02 |
| 2007/0050918 | A1 | 3/2007 | Kim et al. | 8/158 |
| 2008/0289118 | A1 | 11/2008 | Park et al. | 8/159 |
| 2009/0307851 | A1* | 12/2009 | Bae et al. | 8/159 |

FOREIGN PATENT DOCUMENTS

| | | | | |
|---|---|---|---|---|
| DE | 36 06 819 | A1 | | 9/1987 |
| DE | 37 41 792 | A1 | | 6/1989 |
| DE | 38 40 265 | A1 | | 5/1990 |
| DE | 41 22 307 | A1 | | 1/1993 |
| DE | 42 29 646 | A1 | | 3/1994 |
| DE | 44 38 760 | A1 | | 5/1996 |
| DE | 10 2006 017 530 | A1 | | 10/2007 |
| EP | 0 071 308 | A2 | | 2/1983 |
| EP | 0 302 319 | A1 | | 2/1989 |
| EP | 0 763 618 | A2 | | 3/1997 |
| EP | 0 087 706 | | | 11/1997 |
| EP | 1 516 952 | A2 | | 3/2005 |
| EP | 1 538 251 | | | 6/2005 |
| EP | 1 548 169 | A1 | | 6/2005 |
| EP | 1 605 087 | A1 | | 12/2005 |
| EP | 1 693 498 | A2 | | 8/2006 |
| EP | 1 760 181 | | | 3/2007 |
| EP | 1 995 366 | A1 | | 11/2008 |
| EP | 2 128 323 | B1 | | 12/2009 |
| GB | 2 073 257 | | | 10/1981 |
| GB | 2 322 141 | A | | 8/1998 |
| GB | 2 327 502 | A | | 1/1999 |
| JP | 64-040093 | | | 2/1989 |
| JP | 01-268597 | A | | 10/1989 |
| JP | 02-109593 | | | 4/1990 |
| JP | 02-136173 | | | 5/1990 |
| JP | 04-176494 | A | | 6/1992 |
| JP | 05-31292 | A | | 2/1993 |
| JP | 06-218181 | A | | 8/1994 |
| JP | 08-299660 | A | | 11/1996 |
| JP | 10-005485 | A | | 1/1998 |
| JP | 10-127978 | A | | 5/1998 |
| JP | 10-216391 | A | | 8/1998 |
| JP | 11-216296 | A | | 8/1999 |
| JP | 2000-157788 | A | | 6/2000 |
| JP | 2001-224889 | A | | 8/2001 |
| JP | 2001224889 | A | * | 8/2001 |
| JP | 2005-199090 | A | | 7/2005 |
| JP | 2008-054960 | A | | 3/2008 |
| KR | 1994-0015033 | | | 7/1994 |
| KR | 10-2001-0004704 | | | 1/2001 |
| KR | 10-2004-0046049 | A | | 6/2004 |
| KR | 10-2005-0042945 | | | 5/2005 |
| KR | 10-2006-0049526 | | | 5/2006 |
| WO | WO 00/28128 | A1 | | 5/2000 |
| WO | WO 01/90473 | A1 | | 11/2001 |
| WO | WO 2004/009899 | | | 1/2004 |
| WO | WO 2005/106096 | | | 11/2005 |

OTHER PUBLICATIONS

Canadian Office Action dated May 30, 2011 issued in Application No. 2,666,777.

Canadian Office Action dated May 30, 2011 issued in Application No. 2,666,779.

U.S. Office Action dated Jul. 19, 2011 issued in U.S. Appl. No. 12/466,495.

United States Office Action dated Aug. 23, 2011 issued in U.S. Appl. No. 12/470,804.

United States Office Action dated Aug. 23, 2011 issued in U.S. Appl. No. 12/470,818.

United States Office Action dated Aug. 24, 2011 issued in U.S. Appl. No. 12/470,800.

United States Office Action dated Aug. 24, 2011 issued in U.S. Appl. No. 12/470,815.

Chinese Office Action for Application No. 200910141732.1 dated Aug. 19, 2010 and English translation.

European Search Report dated Sep. 11, 2009.

Chinese Office Action dated Oct. 20, 2010 issued in Application No. 200910141728.6.

U.S. Office Action dated Mar. 6, 2012 issued in U.S. Appl. No. 12/470,800.

U.S. Office Action dated Mar. 12, 2012 issued in U.S. Appl. No. 12/470,815.

Office Action dated Jun. 27, 2012 issued in U.S. Appl. No. 12/470,800.

Office Action dated Jul. 25, 2012 issued in U.S. Appl. No. 12/466,495.

European Notice of Opposition dated Aug. 1, 2012 issued in Application No. 09160863.8.

European Notice of Opposition dated Aug. 30, 2012 issued in Application No. 09160863.8.

U.S. Final Office Action dated Feb. 19, 2013 issued in U.S. Appl. No. 12/466,495.

U.S. Office Action dated Aug. 21, 2013 issued in U.S. Appl. No. 12/466,495.

* cited by examiner

WASHING MACHINE AND METHOD OF CONTROLLING A WASHING MACHINE

This application claims priority from Korean Patent Application No. 10-2008-0048186, filed May 23, 2008, the subject of which is incorporated herein by reference.

BACKGROUND

1. Field

Embodiments of the present invention may relate to a washing machine and a method of controlling the washing machine. More particularly, embodiments of the present invention may relate to a washing machine and a method therefore having improved stability and improved laundry balancing at a time of a dehydration cycle.

2. Background

A drum-type washing machine may perform washing by employing a drum that rotates by a driving force of a motor and frictional force of laundry in a state in which a detergent, wash water, and the laundry are input to the drum. The drum-type washing machine may rarely damage the laundry, may rarely entangle the laundry, and may have knocking and rubbing washing effects.

After wash and rinse cycles are finished, a dehydration cycle may be performed. In order to perform the dehydration cycle, laundry is distributed effectively. A variety of methods have been used to distribute the laundry. For example, a method may determine an unbalance amount in a state in which laundry adheres to the drum. However, this method may be disadvantageous in that it has a long balancing time of laundry and the state of laundry may be decided by sensing an unbalance amount of the laundry when the laundry adheres to the drum. Further, when laundry is unbalanced while the laundry adheres to the drum, it may be problematic in stability of a washing machine.

BRIEF DESCRIPTION OF THE DRAWINGS

Objects and features of arrangements and embodiments of the present invention may become apparent from the following description taken in conjunction with the accompanying drawings, in which like reference numerals refer to like elements and wherein.

DETAILED DESCRIPTION

Arrangements and embodiments of the present invention may be described in detail with reference to the accompanying drawings.

Figure 1:
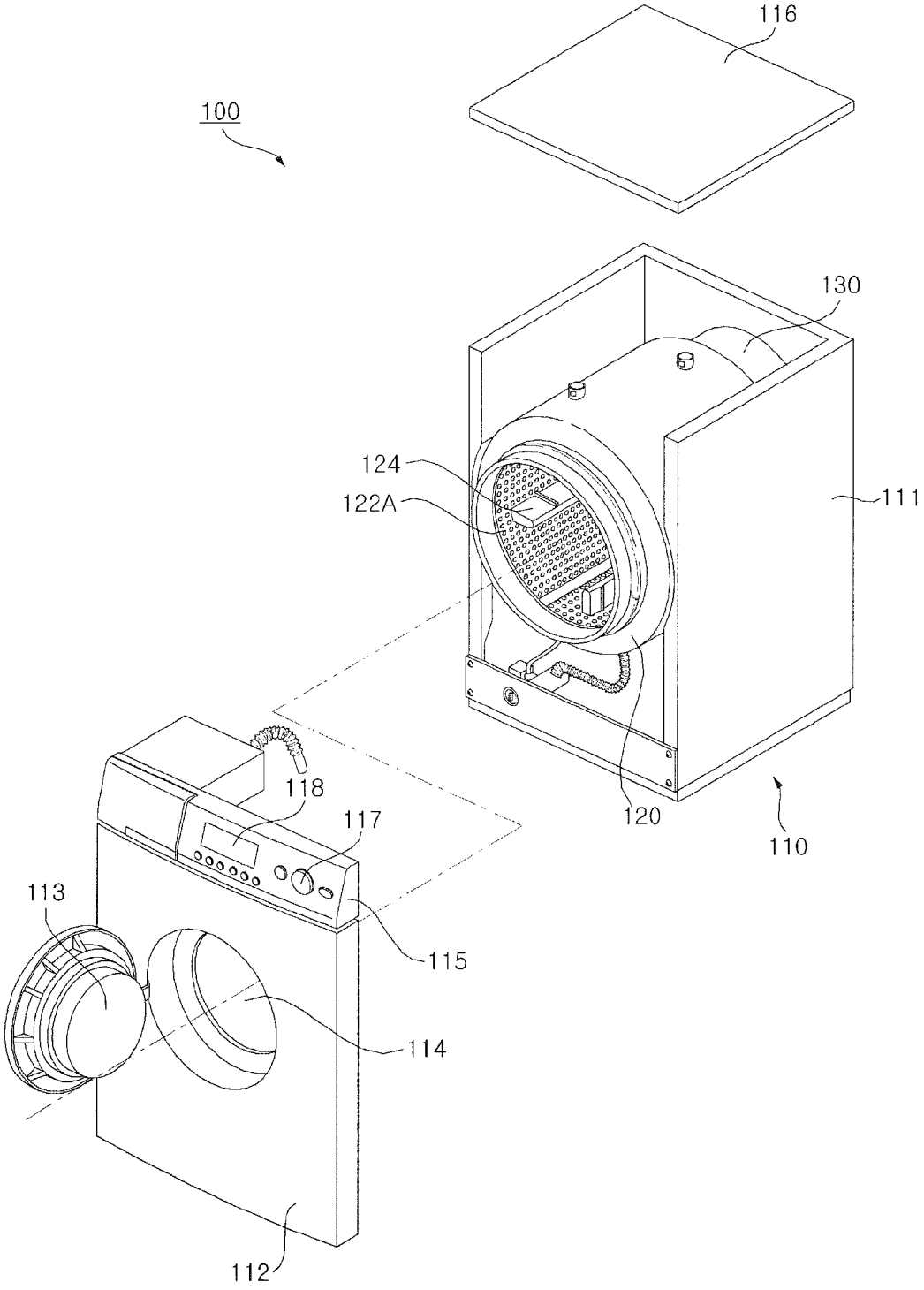
FIG. 1 is a perspective view showing a washing machine in accordance with an example embodiment of the present invention.

FIG. 1 is a perspective view showing a washing machine in accordance with an example embodiment of the present invention. Other embodiments and configurations are also within the scope of the present invention.

More specifically, FIG. 1 shows a washing machine 100 that includes a cabinet 110 forming an external shape of the washing machine 100, a tub 120 disposed within the cabinet 110 and supported by the cabinet 110, a drum 122 disposed within the tub 120 in which laundry is washed, a motor 130 for driving the drum 122, a wash water supply apparatus (not shown) disposed outside a cabinet main body 111 and configured to supply wash water to the cabinet 110, and a drain apparatus (not shown) formed under the tub 120 and configured to drain wash water to outside.

The drum 122 may include a plurality of through-holes 122A for having wash water pass therethrough. Lifters 124 may be disposed within the drum 122 so that laundry may be raised up to a specific height when the drum 122 is rotated and may then be dropped because of gravity.

The cabinet 110 may include the cabinet main body 111, a cabinet cover 112 disposed on a front side of the cabinet main body 111 and coupled thereto, a control panel 115 disposed on an upper side of the cabinet cover 112 and coupled to the cabinet main body 111, and a top plate 116 disposed at the top of the control panel 115 and coupled to the cabinet main body 111.

The cabinet cover 112 may include a laundry inlet/outlet hole 114 formed to have laundry pass therethrough, and a door 113 disposed rotatably left and right so that the laundry inlet/outlet hole 114 may be opened and closed.

The control panel 115 may include a control button 117 for manipulating operating states of the washing machine 100, and a display device 118 disposed on one side of the control button 117 and configured to display operating states of the washing machine 100.

The control button 117 and the display device 118 within the control panel 115 may be electrically connected to a controller (not shown). The controller (not shown) may electrically control respective constituent elements, etc. of the washing machine 100. Operation of the controller (not shown) will be described below.

Figure 2:
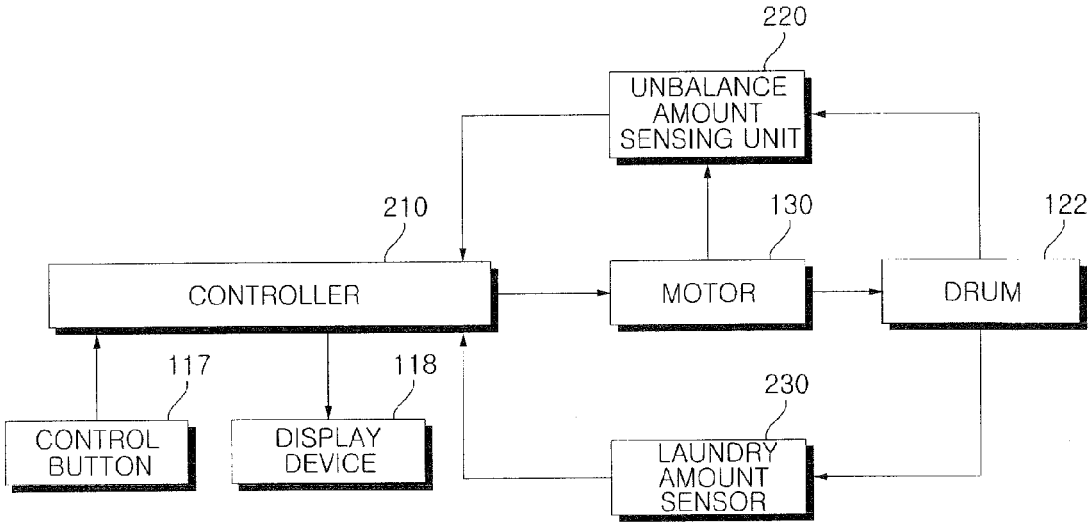
FIG. 2 is an internal block diagram of the washing machine shown in FIG. 1.

FIG. 2 is an internal block diagram of the washing machine shown in FIG. 1. Other embodiments and configurations are also within the scope of the present invention.

FIG. 2 shows a controller 210 that may operate in response to an operation signal received from the control button 117. Actual washing, rinse, and dehydration cycles may be performed. For the actual washing, rinse, and dehydration cycles, the controller 210 may control the motor 130. Although not shown, an inverter (not shown) may be used to control the motor 130. For example, when the controller 210 outputs a pulse width modulated (PWM) switching control signal to the inverter (not shown), the inverter (not shown) may perform a high-speed switching operation in order to supply an AC power of a specific frequency to the motor 130.

The controller 210 may display operating states of the washing machine 100 through the display device 118. For example, the controller 210 may display operating states, such as actual washing, rinse, and dehydration cycles, through the display device 118.

The motor 130 may drive or rotate the drum 122. The drum 122 may be disposed within the tub 120, as shown in FIG. 1, and may allow for laundry to be input for washing. The drum 122 may be driven by rotation of the motor 130.

An unbalance amount sensing unit 220 may sense an unbalance amount of the drum 122 (i.e., an unbalance (UB) of the drum 122). The unbalance amount may be sensed based on a rotation speed variation of the drum 122 (i.e., a rotation speed variation of the motor 130). As such, a speed sensor (not shown) may also sense a rotation speed of the motor 130. A rotation speed of the motor 130 may be calculated based on an output current value flowing through the motor 130, and an unbalance amount may be sensed based on the rotation speed. As such, the motor 130 may include a current sensor (not shown) such as an encoder.

Although the unbalance amount sensing unit 220 is shown as being provided separately from the controller 210, embodiments of the present invention are not limited to this configuration. For example, the unbalance amount sensing unit 220 may be included within the controller 210. In such an example, a rotation speed and an output current value of the motor 130, which are respectively sensed by the speed sensor (not shown) and the current sensor (not shown), may be input to the controller 210.

The washing machine may further include a laundry amount sensor 230. The laundry amount sensor 230 may sense an amount of laundry within the drum 122 and may provide an indication of an amount of load of sensed laundry to the controller 210. The sensing of the laundry amount may be performed by sensing weight of the laundry within the drum 122, a rotational speed of the drum 122, etc. anytime the drum 122 is stopped or is operated. The laundry amount sensor 230 is illustrated in FIG. 2 as being separate from the controller 210. However, the laundry amount sensor 230 may be included in the controller 210.

Figure 3:
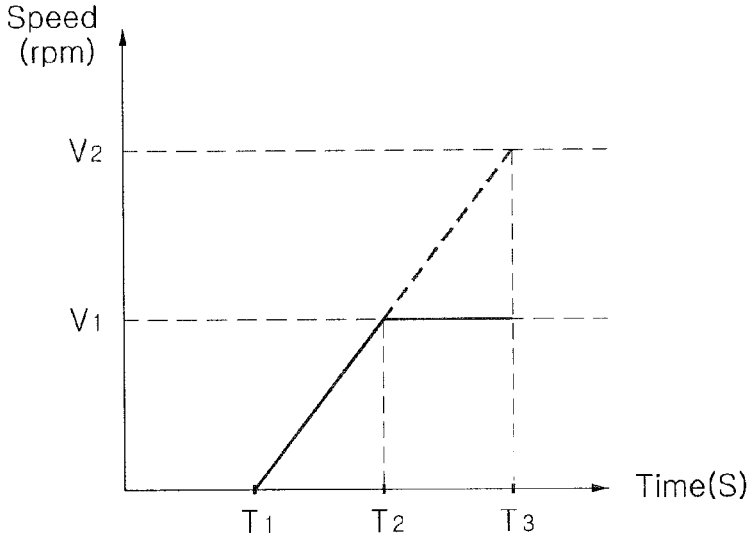
FIG. 3 is a graph showing a relationship between time and a speed of a drum within the washing machine shown in FIG. 1.

FIG. 3 is a graph showing a relationship between time and a rotational speed of the drum within the washing machine of FIG. 1. Other graphs and embodiments are also within the scope of the present invention.

A determination may be made whether to operate the drum at a first speed V1 or a second speed V2 based on a laundry amount sensed by the laundry amount sensor 230. When the sensed laundry amount exceeds a first specific value, the drum 122 may operate at the first speed V1. On the other hand, when the sensed laundry amount is the first specific value or less, the drum 122 may operate at the second speed V2.

The first speed V1 may be a speed at which part of laundry tumbles within the drum 122 and another part of the laundry adheres to the drum 122. The second speed V2 may be a speed at which the entire laundry adheres to the drum 122.

As the laundry amount increases, balancing of laundry may have to be controlled more accurately. Thus, the first speed V1 may be controlled to make a better laundry distribution state. As the laundry amount decreases, the first speed V1 may be controlled to operate the drum 122 in a laundry adhesion state.

The drum 122 may start operating (or rotating) at a first time point T1, and rotational speed of the drum 122 may increase at a specific rising slope. A decision may be made to continue either at the first speed V1 or to increase to the second speed V2 according to the laundry amount sensed at a second time point T2. However, embodiments of the present invention are not limited to the above example. For example, an operating speed of the drum 122 may be decided before the drum 122 operates. Additionally, in an example in which the drum 122 operates (or rotates) at the second speed V2, the second speed V2 operation may start from a third time point T3.

On the other hand, before the first time point T1, a laundry loose process may be performed. In other words, after the laundry loose process in which the entire laundry tumbles is performed at least once, the first speed V1 operation or the second speed V2 operation may be decided according to a sensed laundry amount.

Figure 4:
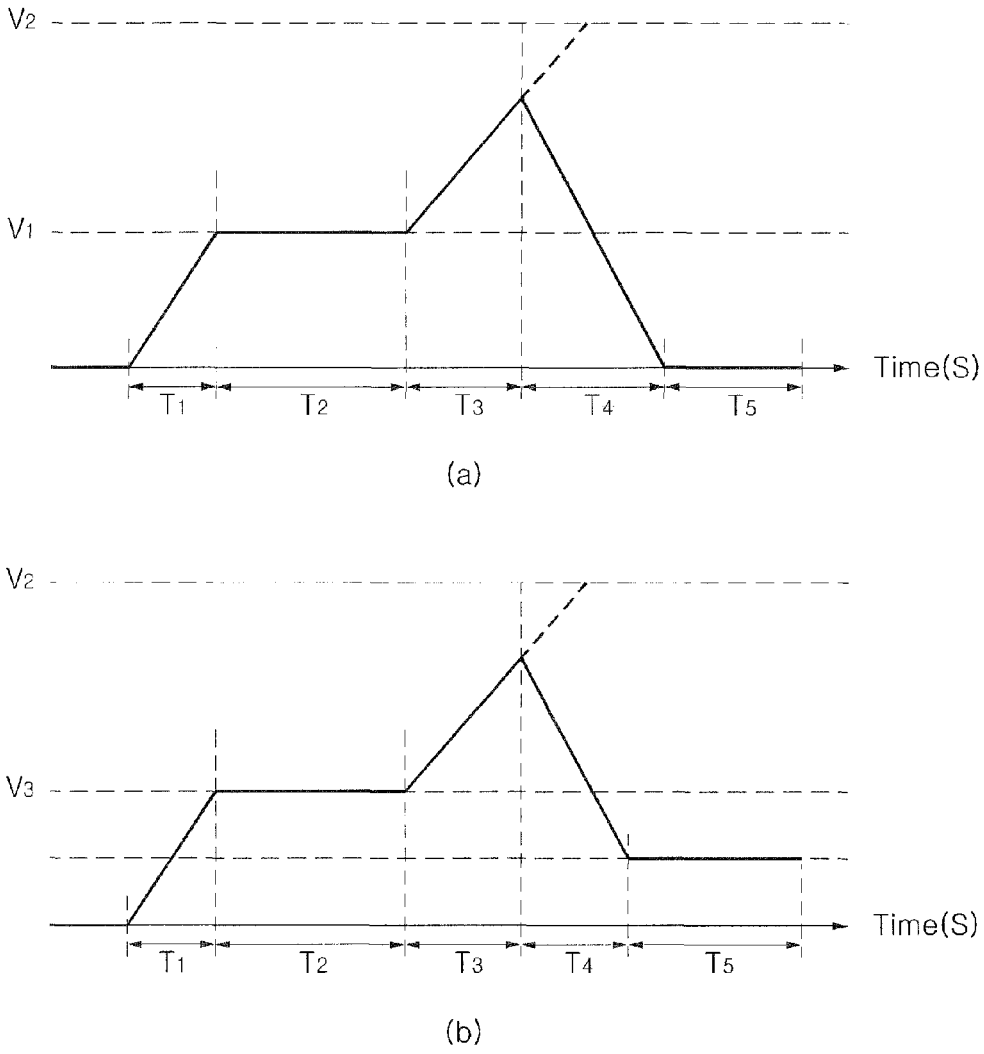
FIGS. 4(*a*)-4(*b*) are graphs showing relationships between time and a speed of a drum within the washing machine shown in FIG. 1.
Figure 5:
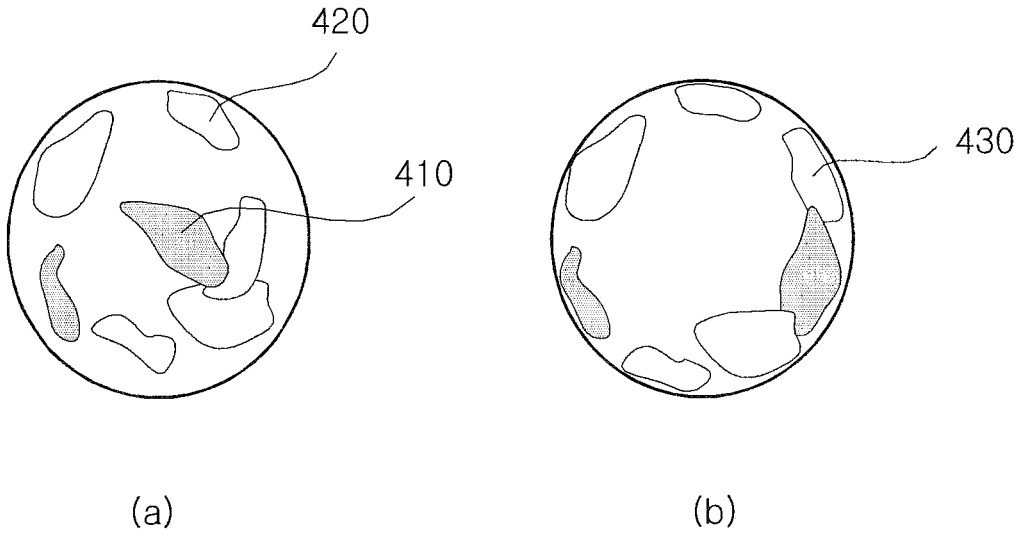
FIG. 5 is a diagram showing states of laundry within a drum according to a first speed and a second speed.

FIGS. 4(*a*)-4(*b*) are graphs showing relationships between time and a speed of the drum within the washing machine shown in FIG. 1. FIG. 5 is a diagram showing states of laundry within a drum according to a first speed and a second speed. Other states, graphs and/or diagrams are also within the scope of the present invention.

As shown in FIG. 4(*a*), rotational speed of the drum 122 may increase to the first speed V1 during the first period T1. The first speed V1 may be a speed at which part 410 of laundry tumbles within the drum 122 and another part 420 of the laundry adheres to the drum 122, as shown in FIG. 5(*a*). For example, the first speed V1 may be a speed at which 20% to 30% of a total amount of laundry tumbles within the drum 122 and 70% to 80% of the total amount of laundry adheres to the drum 122.

During the second period T2, the drum 122 operates (or rotates) at the first speed V1. If an unbalance amount sensed by the unbalance amount sensing unit 220 is a first specific value or less (i.e., if the rotational speed of the drum has been stabilized) during the first speed operation, the rotational speed of the drum 122 increases to the second speed V2. The second speed V2 may be a speed at which the entire laundry 430 adheres to the drum 122, as shown in FIG. 5(*b*).

During a third period T3, the rotational speed of the drum 122 increases toward a second speed V2 at a specific slope. If a detected unbalance amount of the drum 122 is a second specific value or greater (i.e., if it is determined that an abnormality has occurred) while the rotational speed of the drum 122 is increasing to the second speed V2, the drum 122 may stop or decelerate rotation.

FIG. 4(*a*) shows an example where the drum 122 stops and FIG. 4(*b*) shows an example where the drum 122 decelerates and then operates at a third speed V3 less than the first speed V1. In the example in which the drum 122 stops as shown in FIG. 4(*a*), the speed of the drum 122 may decelerate during a fourth period T4 and may then stop during a fifth period T5. In the example in which the speed of the drum 122 decelerates to the third speed V3 as shown in FIG. 4(*b*), the speed of the drum 122 decelerates during the fourth period T4 and the drum 122 then operates at the third speed V3 during the fifth period T5.

The drum 122 may stop or decelerate as soon as an abnormality occurs by determining an unbalance amount of the drum while the rotational speed of the drum 122 is increasing to the second speed V2.

Since an operation speed of the drum 122 may be decided according to a laundry amount, balancing of laundry can be improved efficiently.

In addition, after the first speed V1 operation, an unbalance amount of the drum 122 may be determined while the rotational speed of the drum 122 increases to the second speed V2. When an abnormality occurs, the drum 122 may stop or decelerate immediately. Accordingly, at the time of the dehydration cycle, stability of the washing machine 100 and laundry balancing can be ensured. Meanwhile, the drum 122 may be driven at the first speed V1 at which part of laundry tumbles to meet a balancing state of the laundry to some extent, and not at a speed at which the entire laundry tumbles as in disadvantageous arrangements. The drum may then operate at the second speed V2. Accordingly, laundry may be distributed accurately and rapidly.

The first speed V1 may be approximately 60 rpm, the second speed V2 may be approximately 108 rpm, and the third speed V3 may be approximately 30 rpm. Other speeds are also within the scope of the present invention.

Figure 6:
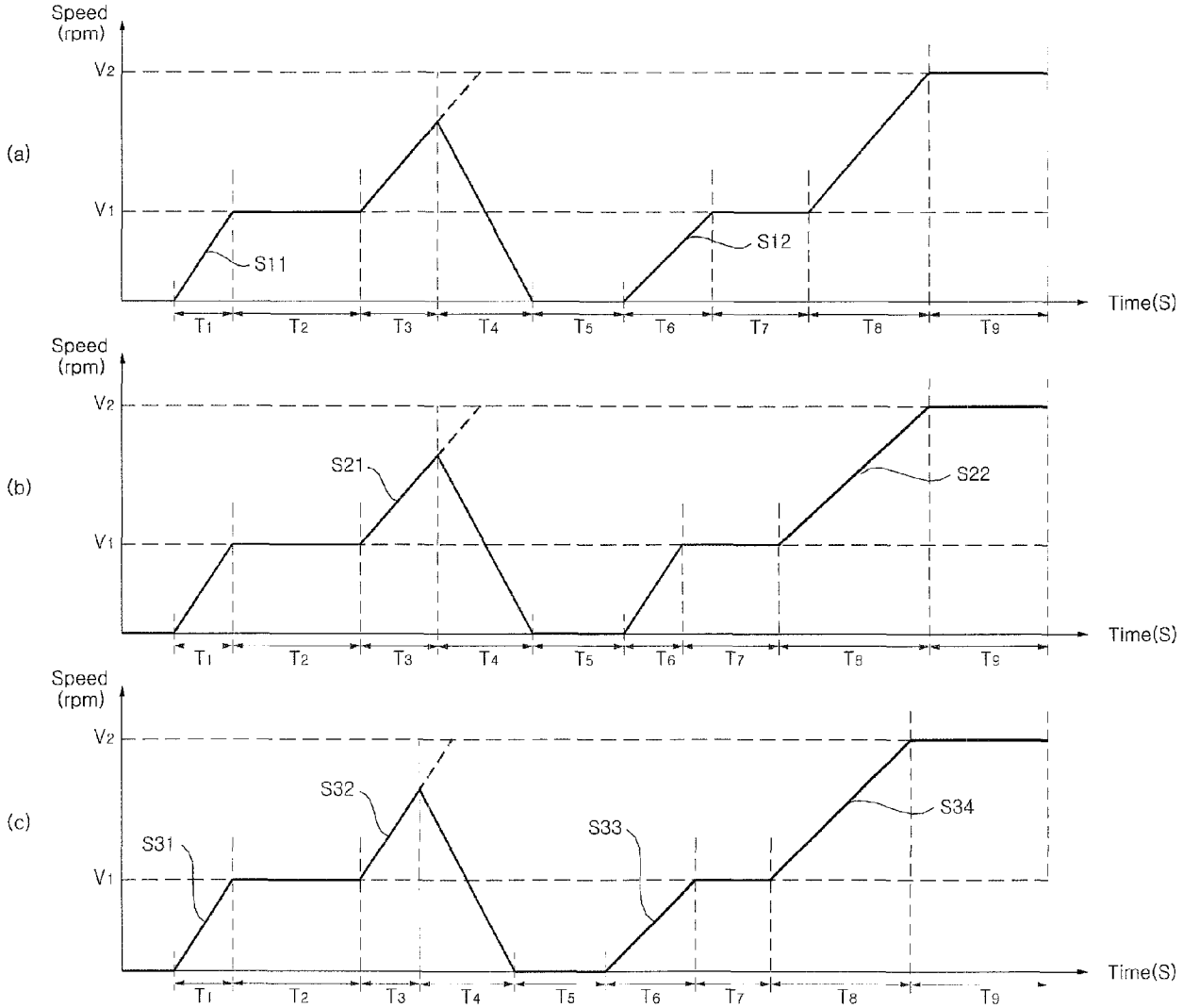
FIGS. 6(*a*)-6(*c*) are graphs showing relationships between time and a speed of a drum within the washing machine shown in FIG. 1.

FIGS. 6(*a*)-6(*c*) are graphs showing relationships between time and a speed of the drum within the washing machine shown in FIG. 1. Other graphs and embodiments are also within the scope of the present invention.

The graphs of FIGS. 6(*a*) to 6(*c*) are similar to FIG. 4(*a*). More specifically, similar to FIG. 4(*a*), speed of the drum 122 increases to the first speed V1 during the first period T1, the drum rotates at the first speed V1 during the second period T2, speed of the drum 122 increases to the second speed V2 during the third period T3, speed of the drum 122 decreases to a stopped state during a fourth period T4, and the drum 122 stops rotation during a fifth period T5.

When the drum 122 operates or rotates again after stopping during the fifth period T5, the rotational speed of the drum 122 increases to the first speed V1 again during a sixth period T6, and the drum 122 then operates at the first speed V1 during a seventh period T7. If an unbalance amount sensed by the unbalance amount sensing unit 220 during the first speed V1 operation is a first specific value or less (i.e., the speed of the drum 122 has been stabilized), the rotational speed of the drum 122 increases to the second speed V2. The second speed V2 may be a speed at which the entire laundry 430 adheres to the drum 122 as shown in FIG. 5(*b*).

During an eighth period T8, a rotational speed of the drum 122 increases to the second speed V2 at a specific slope. If an unbalance amount of the drum 122 is not the second specific value or greater while the rotational speed of the drum 122 increases to the second speed V2 (i.e., the speed of the drum has been stabilized), the drum 122 operates at the second speed V2 during a ninth period T9.

When the drum 122 operates or rotates after the sixth period T6, at least one of a first speed V1 rising slope and a second speed V2 rising slope can be changed (from previous slopes of speed). This may improve stability of the washing machine 100 and a laundry balancing state by considering that a sensed unbalance amount is the second specific value or greater (i.e., when an abnormality occurs) when the rotational speed of the drum 122 increases to the second speed V2.

The first speed V1 rising slope and the second speed V2 rising slope may be changed within a specific range. For example, when the drum 122 operates or rotates again, the first speed (V1) rising slope and the second speed (V2) rising slope may be made gentle to improve stability of the washing machine and balancing of laundry. However, embodiments of the present invention are not limited to the above example. For example, each of the first speed (V1) rising slope and the second speed (V2) rising slope may be abruptly changed within a specific range.

When the drum 122 operates or rotates again after the sixth period T6, the drum 122 can operate or rotate in a reverse direction. In other words, when the drum 122 operates or rotates in a first direction during the first to fourth periods T1 to T4, the drum 122 may operate or rotate in a second direction, opposite to the first direction, when the drum 122 operates or rotates again after the sixth period T6.

FIG. 6(*a*) shows an example where first speed rising slopes S11 and S12 are changed (or are different) before and after the drum operates or rotates again. FIG. 6(*b*) shows an example where second speed rising slopes S21 and S22 are changed (or are different) before and after the drum operates or rotates again. FIG. 6(*c*) shows an example where first speed rising slopes S31 and S33 and second speed rising slopes S32 and S34 are changed (or are different) before and after the drum 122 operates or rotates again.

At least one water drain process, operated at a resonant speed or less to remove moisture contained in laundry, may be performed after the second speed (V2) operation in which the entire laundry adheres to the drum 122. After the water drain process is completed, the full-scale dehydration process can be performed in which the drum 122 operates at a maximum speed.

Relationships between time and the rotational speed of the drum 122, as shown in FIGS. 4 and 6 may be established based on operating states of the controller 210. That is, the controller 210 may control an operating speed, an operating time, etc. of the drum 122 in consideration of an unbalance amount of the drum, operation commands, the laundry amount, the type of laundry, etc.

Figure 7:
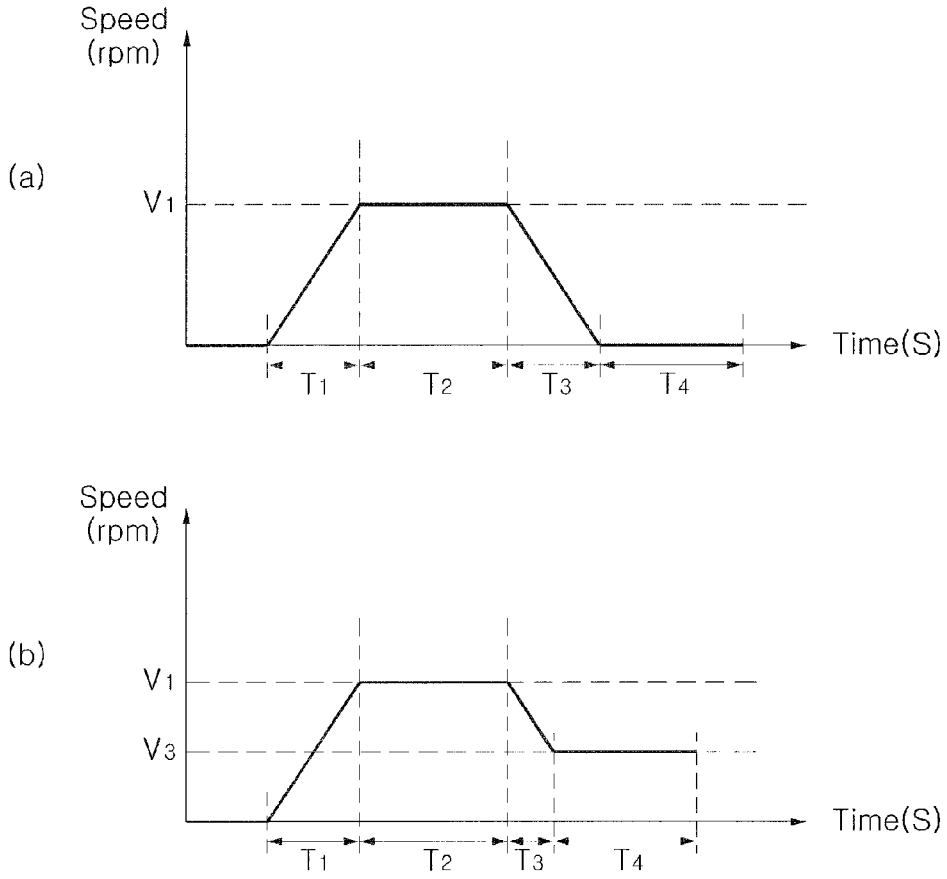
FIGS. 7(*a*)-7(*b*) are graphs showing relationships between time and a speed of a drum within the washing machine shown in FIG. 1.

FIGS. 7(*a*)-7(*b*) are graphs showing relationships between time and a speed of the drum within the washing machine shown in FIG. 1. Other graphs and embodiments are also within the scope of the present invention.

As shown in FIGS. 7(*a*)-(7*b*), the rotational speed of the drum 122 may increase to the first speed V1 during the first period T1. During the second period T2, the drum 122 may operate or rotate at the first speed V1. When an unbalance amount sensed by the unbalance amount sensing unit 220 during the first speed (V1) operation exceeds a first specific value (i.e., if it is determined that abnormality has occurred), then the drum 122 stops or decelerates rotation.

FIG. 7(*a*) shows an example where the drum 122 stops rotation. FIG. 7(*b*) shows an example where the drum 122 decelerates rotation and then operates at the third speed V3.

An unbalance amount of the drum 122 during the first speed (V1) operation may be determined. When an abnormality occurs, the drum 122 may stop or decelerate rotation immediately. Accordingly, at the time of the dehydration cycle, stability of the washing machine 100 and laundry balancing may be ensured.

Figure 8:
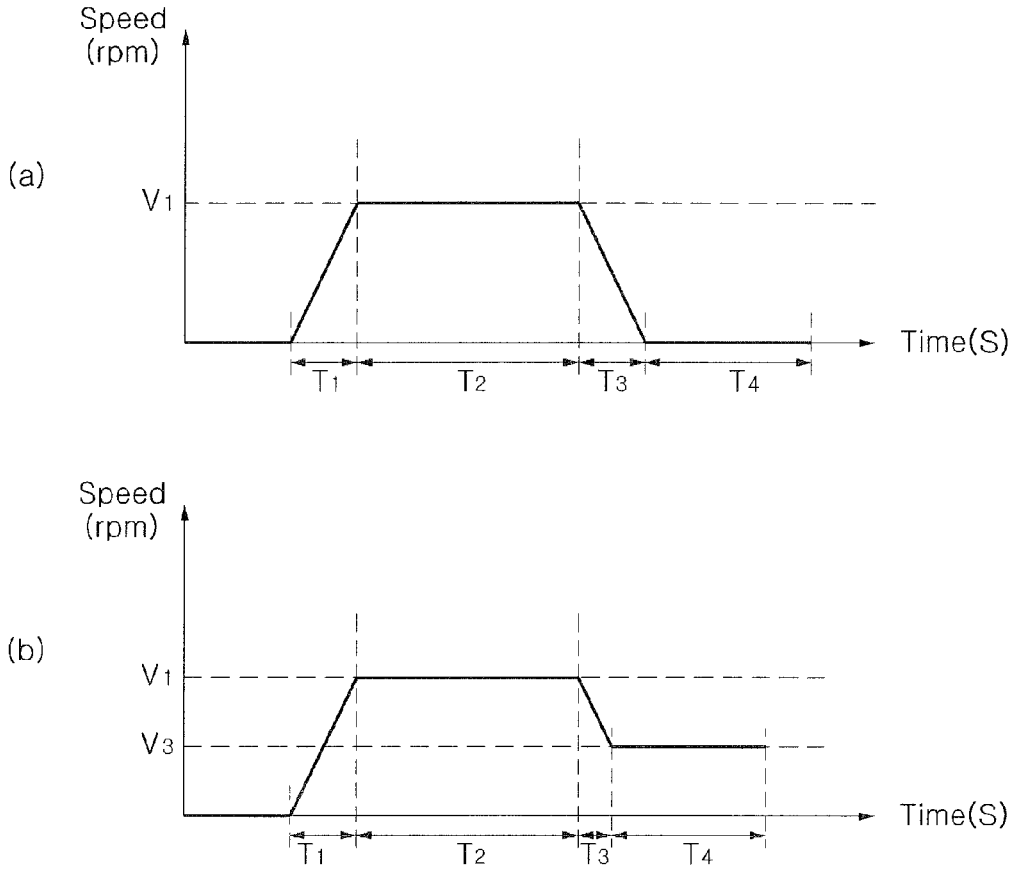
FIGS. 8(*a*)-8(*b*) are graphs showing relationships between time and a speed of a drum within the washing machine shown in FIG. 1.

FIGS. 8(*a*)-8(*b*) are graphs showing relationships between time and a speed of the drum within the washing machine shown in FIG. 1. Other graphs and embodiments are also within the scope of the present invention.

As shown in FIGS. 8(*a*)-8(*b*), the rotational speed of the drum 122 may increase to the first speed V1 during the first period T1. FIG. 8 differs from FIG. 7 in that when an operating time at the first speed is a specific time or greater, the drum 122 may stop or decelerate rotation.

FIG. 8(*a*) shows an example where the drum 122 stops rotation. FIG. 8(*b*) shows an example where the drum 122 decelerates rotation and then operates at the third speed V3. Accordingly, stability of the washing machine and laundry balancing may be ensured.

Figure 9:
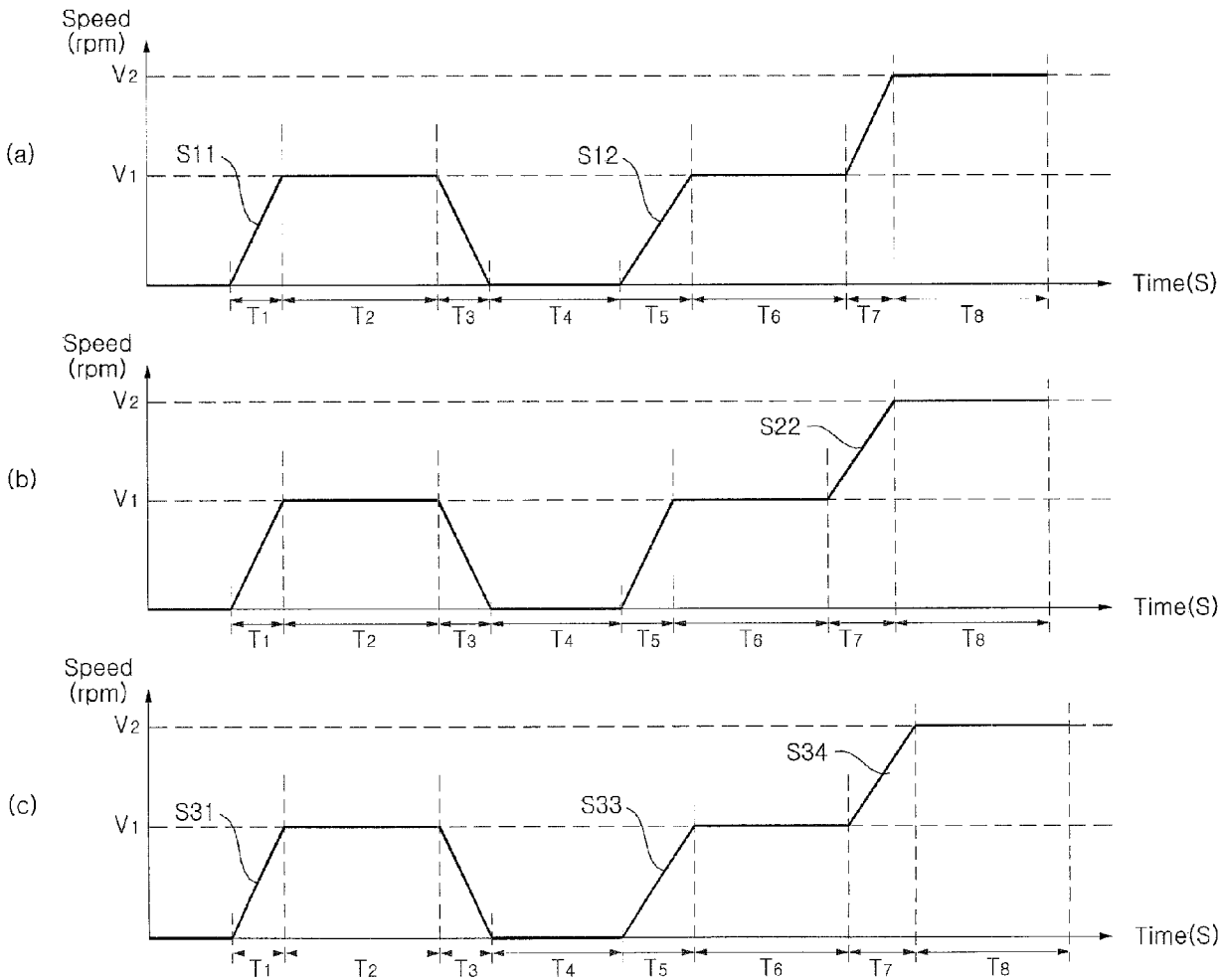
FIGS. 9(*a*)-9(*c*) are graphs showing relationships between time and a speed of a drum within the washing machine shown in FIG. 1.

FIGS. 9(*a*)-9(*c*) are graphs showing relationships between time and a speed of the drum within the washing machine shown in FIG. 1. Other graphs and embodiments are also within the scope of the present invention.

As shown in FIGS. 9(*a*)-9(*c*), the rotational speed of the drum 122 increases to the first speed V1 during the first period T1.

Operations in FIGS. 9(*a*)-9(*c*) between the first to fourth periods T1 to T4 may be similar to operations of FIG. 7(*a*), and operations subsequent to stopping or decelerating may be similar to operations of FIG. 6. In other words, when the drum 122 operates or rotates again, at least one of a first speed rising slope and a second speed rising slope may change (from previous slopes of speed). Accordingly, stability of the washing machine and balancing of laundry can be improved.

Figure 10:
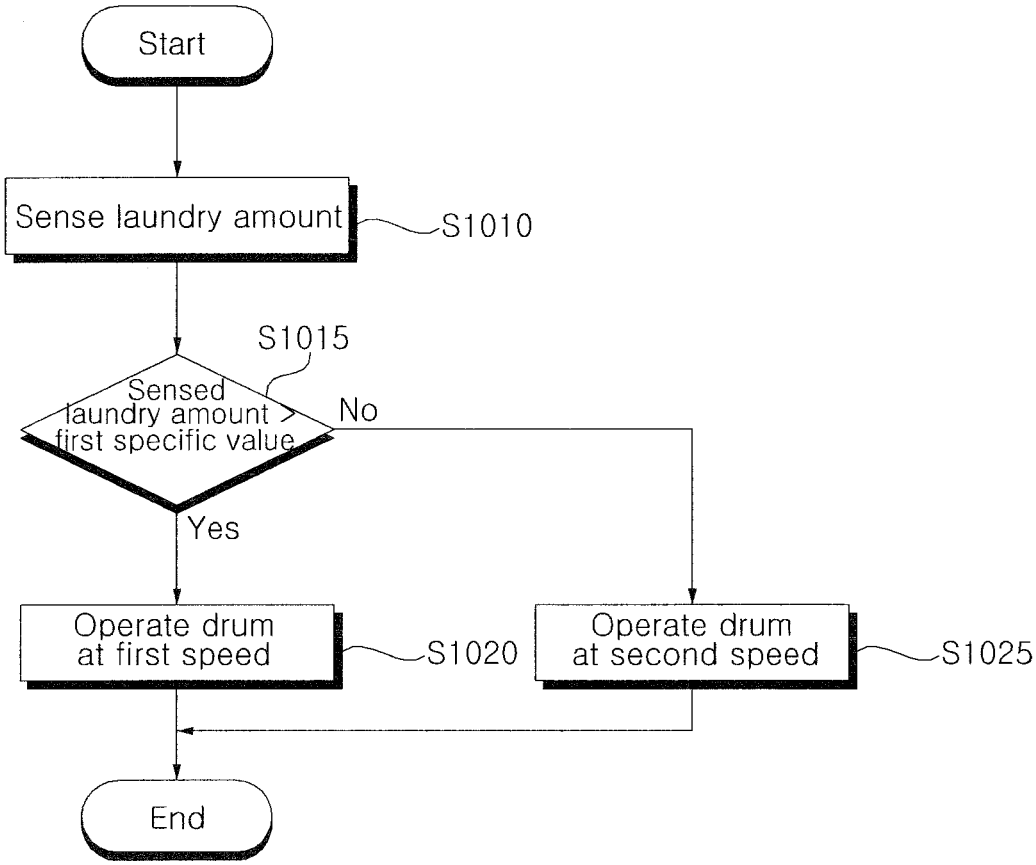
FIG. 10 is a flowchart illustrating a method of controlling a washing machine in accordance with an example embodiment of the present invention.

FIG. 10 is a flowchart illustrating a method of controlling a washing machine in accordance with an example embodiment of the present invention. Other operations, orders of operations and embodiments are also within the scope of the present invention.

A laundry amount within the drum 122 may be sensed in operation S1010 by the laundry amount sensor 230. The sensed result may be input to the controller 210.

A determination may be made in operation S1015 whether the sensed laundry amount exceeds a first specific value. If the sensed laundry amount exceeds the first specific value, then the drum 122 may operate or rotate at the first speed V1 in operation S1020. If the sensed laundry amount is determined to be the first specific value or less, then the drum 122 may operate or rotate at the second speed V2 in operation S1025. Since an operation speed of the drum 122 may be decided according to a sensed laundry amount, balancing of laundry can be improved efficiently.

Although not shown, before the first or second speed operations, a laundry loose process may be performed at a speed at which the entire laundry tumbles. After the laundry loose process, a laundry balancing process may be performed to further improve balancing of laundry.

Figure 11:
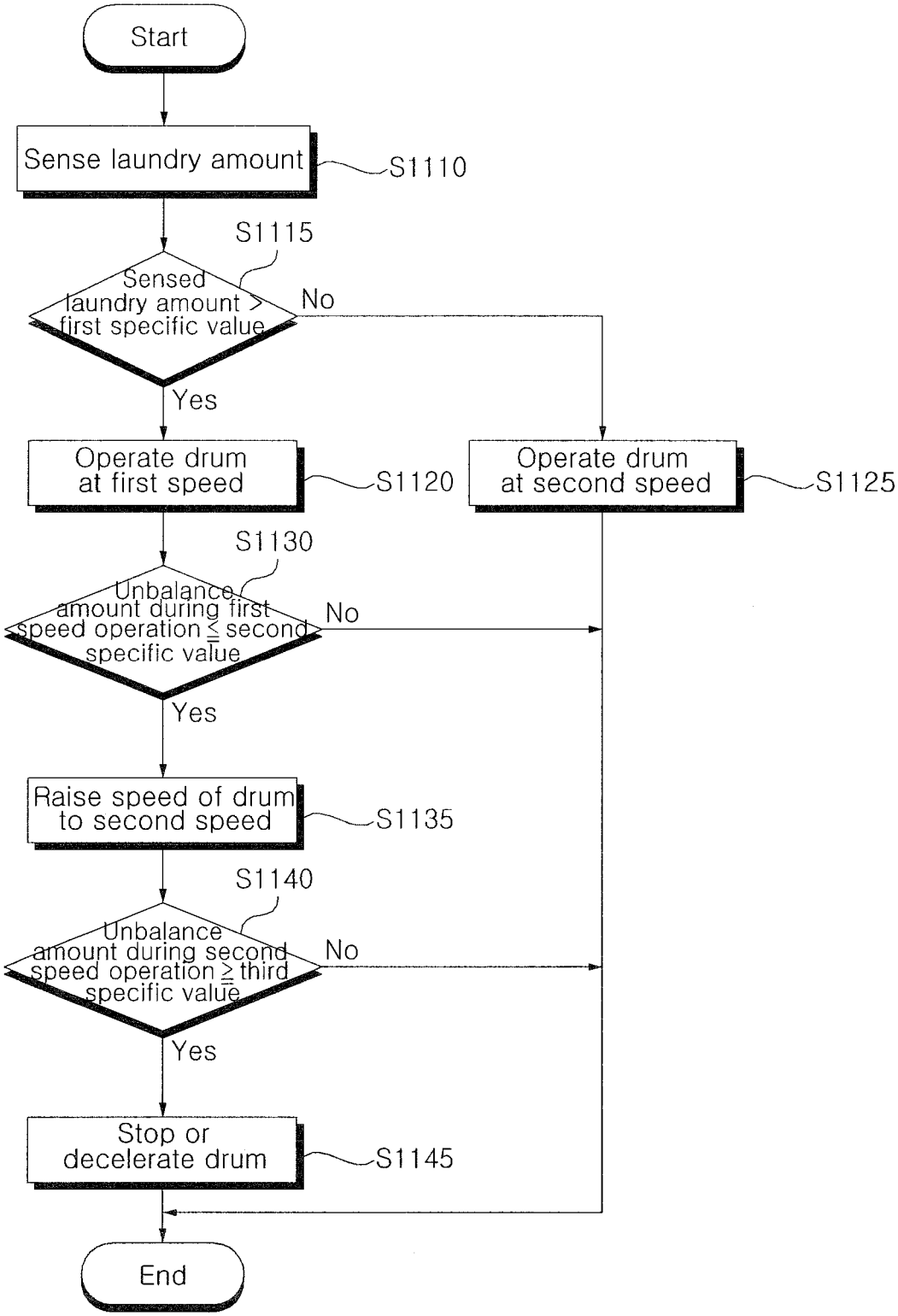
FIG. 11 is a flowchart illustrating a method of controlling a washing machine in accordance with an example embodiment of the present invention.

FIG. 11 is a flowchart illustrating a method of controlling a washing machine in accordance with an example embodiment of the present invention. Other operations, orders of operations and embodiments are also within the scope of the present invention.

A laundry amount sensing operation S1110, a first speed operation S1120 and/or a second speed operation S1125 according to a laundry amount determination operation S1115 in FIG. 11 may be similar or identical to operations in FIG. 10. A redundant description thereof may be omitted for simplicity.

After the first speed operation S1120, the controller 210 may determine in operation S1130 whether an unbalance amount sensed during the first speed (V1) operation is a second specific value or less. If the unbalance amount sensed during the first speed (V1) operation is the second specific value or less, the controller 210 may increase the rotational speed of the drum 122 to the second speed V2 in operation S1135.

The controller 210 may determine in operation S1140 whether an unbalance amount of the drum 122 sensed while the rotational speed of the drum 122 increases to the second speed V2 is a third specific value or greater. If the unbalance amount of the drum 122 sensed while the rotational speed of the drum 122 increases to the second speed V2 is the third specific value or greater, the controller 210 may stop or decelerate rotation of the drum 122 in operation S1145. Accordingly, stability of the washing machine 100 and balancing of laundry may be ensured.

Figure 12:
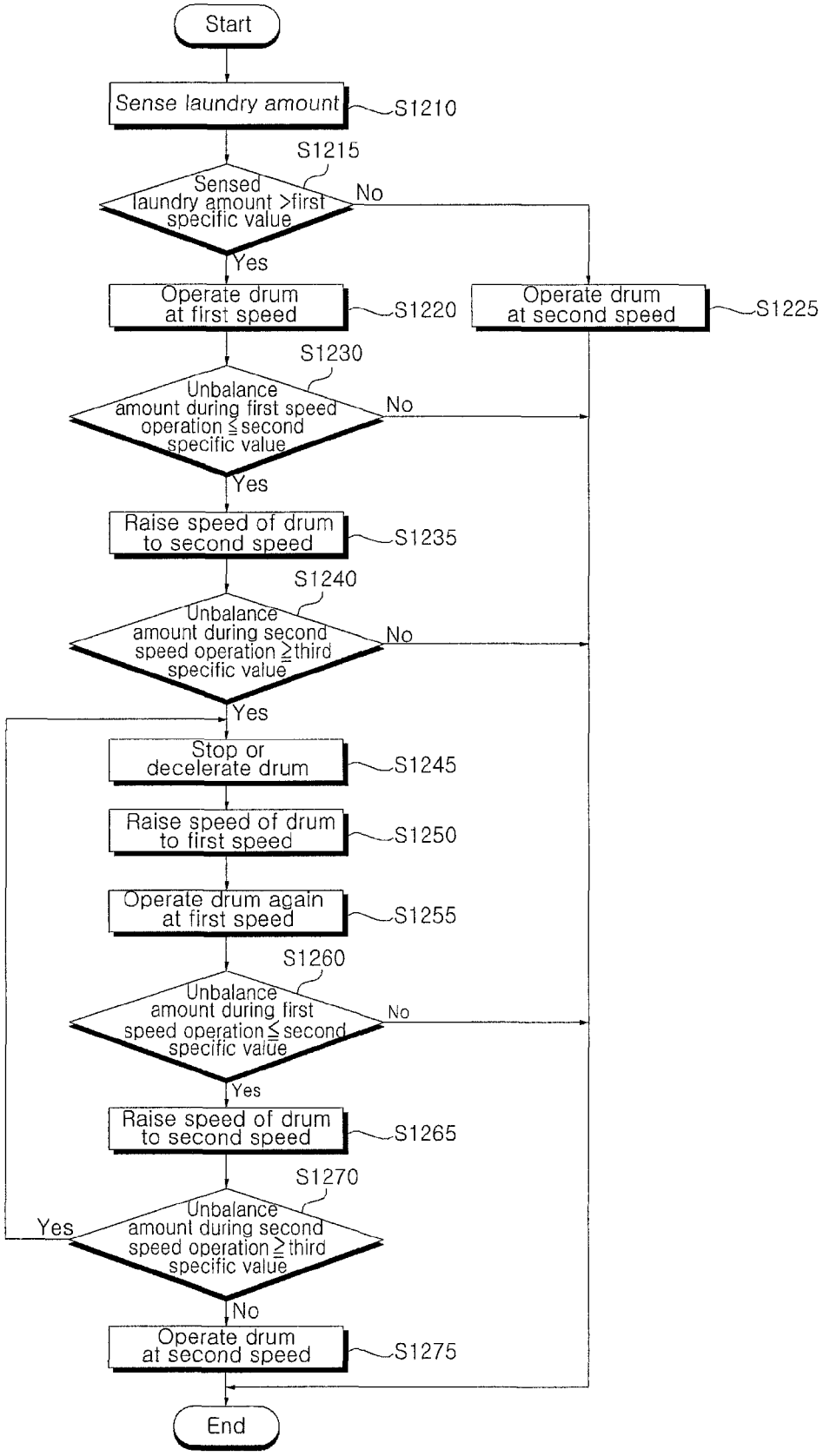
FIG. 12 is a flowchart illustrating a method of controlling a washing machine in accordance with an example embodiment of the present invention.

FIG. 12 is a flowchart illustrating a method of controlling a washing machine in accordance with an example embodiment of the present invention. Other operations, orders of operations and embodiments are also within the scope of the present invention.

The method of FIG. 12 may be similar to the method of FIG. 11. Operations S1215, S1220, S1230, S1235, S1240 and S1225 between a laundry amount sensing operation S1210 and a stop or deceleration operation S1245 may be similar to operations in FIG. 11. A redundant description thereof may be omitted for simplicity.

After the stop or deceleration operation S1245, the controller 210 may increase the rotational speed of the drum 122 to the first speed V1 in operation S1250. At this time, a first speed V1 rising slope may be changed to improve balancing of laundry.

The controller 210 may operate or rotate the drum 122 again at the first speed V1 in operation S1255.

The controller 210 may then determine whether an unbalance amount of the drum 122, which is sensed during the first speed V1 operation, is the second specific value or less in operation S1260.

If the unbalance amount of the drum 122 during the first speed V1 operation is determined to be the second specific value or less, the controller 210 may increase the rotational speed of the drum 122 to the second speed V2 in operation S1265. At this time, a second speed V2 rising slope may be changed to improve balancing of laundry.

The controller 210 may determine whether an unbalance amount of the drum 122, which is sensed while rotational speed of the drum 122 increases to the second speed V2, is a third specific value or greater in operation S1270.

If the unbalance amount of the drum 122 in operation S1270 is determined to be the third specific value or greater, the controller 210 may stop or decelerate rotation of the drum 122 in operation S1245. If the unbalance amount of the drum 122 in operation S1270 is determined to not be the third specific value or greater, the controller 210 controls the drum to operate at the second speed in operation S1275.

Further, when the drum 122 operates again after the stop or deceleration operation S1245, the drum 122 may operate or rotate in a reverse direction. In other words, in the example in which the drum 122 operates in a first direction during the first speed operation S1220 to the stop or deceleration operation S1245, the drum 122 may further operate or rotate in a second direction, opposite to the first direction, when the drum operates again after the first speed rising operation S1250.

After the first speed operation, an unbalance amount of the drum 122, which is sensed while the rotational speed of the drum 122 increases to the second speed, may be determined. When an abnormality occurs, the drum 122 may stop or decelerate immediately. Accordingly, at the time of the dehydration cycle, stability of the washing machine 100 and laundry balancing can be ensured. Further, when the drum 122 operates again, at least one of the first speed rising slope and the second speed rising slope may change (from a previous slope of the speed). Accordingly, stability of the washing machine and balancing of laundry can be improved.

In addition, the drum 122 may be driven at the first speed V1 at which part of laundry tumbles so as to meet a balancing state of the laundry to some extent, and not at a speed at which the entire laundry tumbles as in disadvantageous arrangements. The drum 122 may then operate at the second speed V2. Accordingly, laundry can be distributed accurately and rapidly.

The first speed V1 may be approximately 60 rpm, the second speed V2 may be approximately 108 rpm, and the third speed V3 may be approximately 30 rpm. Other speeds are also within the scope of the present invention.

Figure 13:
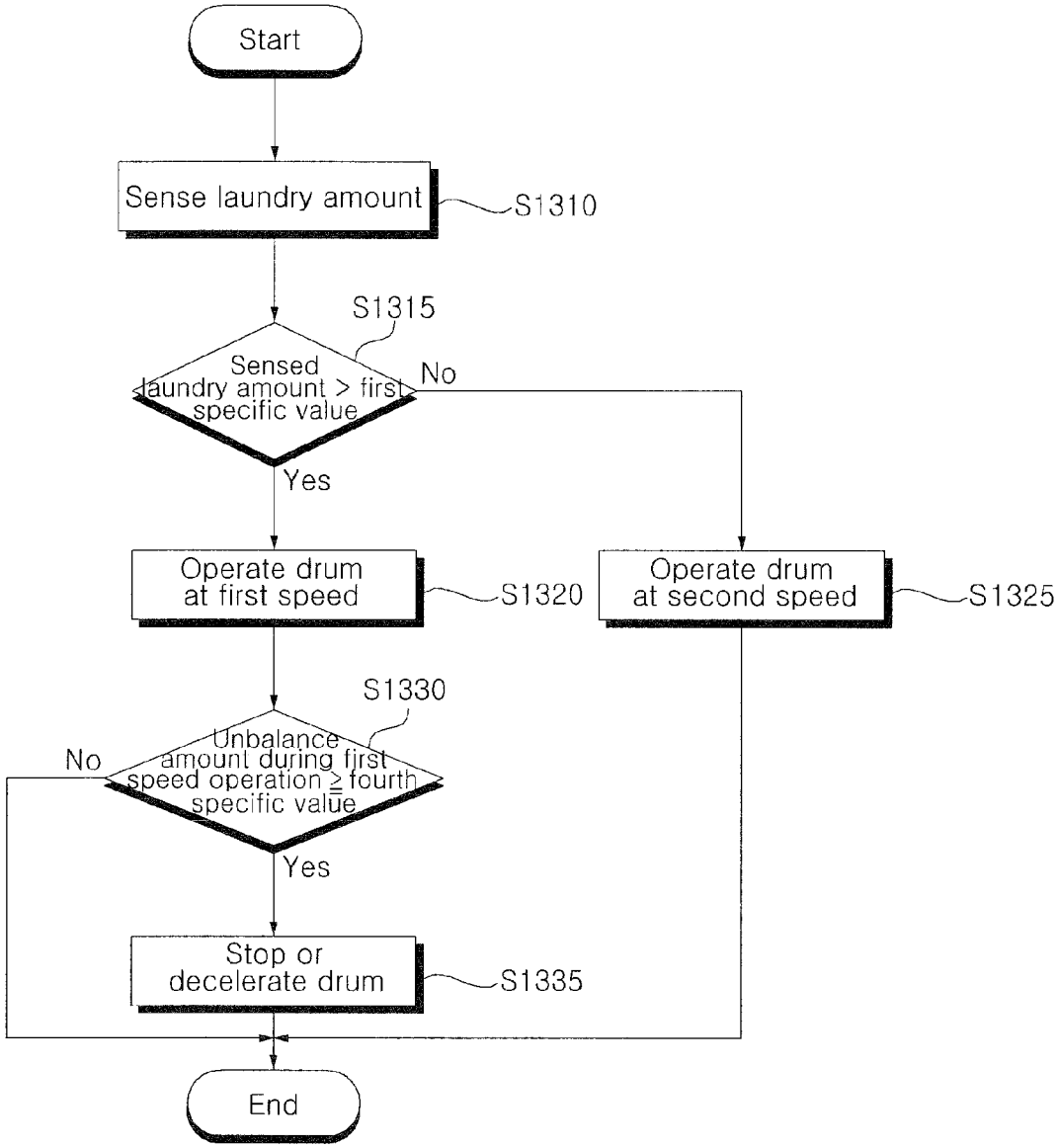
FIG. 13 is a flowchart illustrating a method of controlling a washing machine in accordance with an example embodiment of the present invention.

FIG. 13 is a flowchart illustrating a method of controlling a washing machine in accordance with an example embodiment of the present invention. Other operations, orders of operations and embodiments are also within the scope of the present invention.

Operations such as a laundry amount sensing operation S1310, a determination operation S1315, a first speed operation S1320, a second speed operation S1325 and a laundry amount determination operation S1315 shown in FIG. 13 may be similar or identical to operations in FIG. 10.

Additionally, after the first speed operation S1320, the controller 210 may determine whether an unbalance amount of the drum 122 is a fourth specific value or greater in operation S1330. If the unbalance amount of the drum 122 in operation S1330 is the fourth specific value or greater, the controller 210 may stop or decelerate rotation of the drum 122 in operation S1335. Accordingly, stability of the washing machine 100 and balancing of laundry can be ensured.

Figure 14:
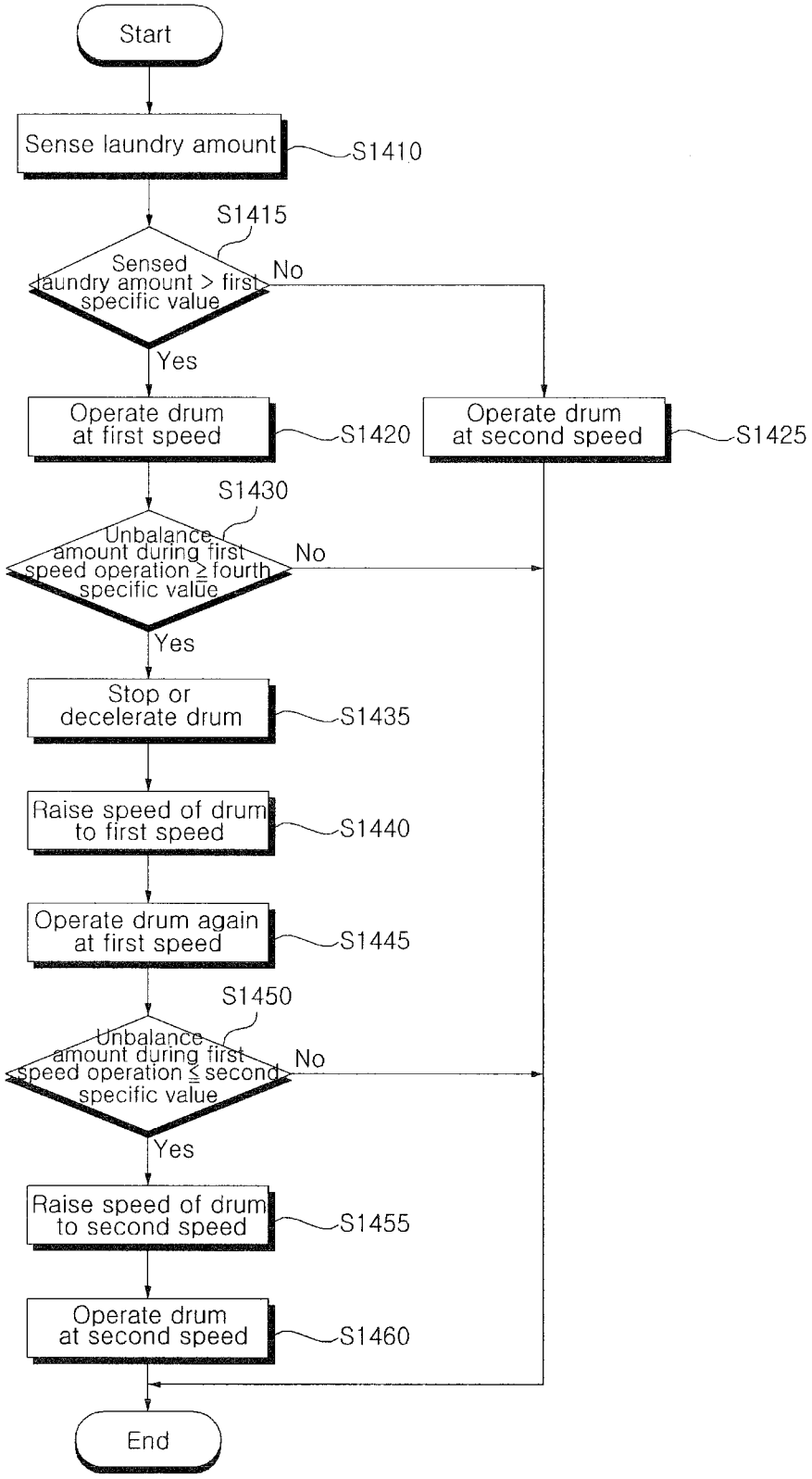
FIG. 14 is a flowchart illustrating a method of controlling a washing machine in accordance with an example embodiment of the present invention.

FIG. 14 is a flowchart illustrating a method of controlling a washing machine in accordance with an example embodiment of the present invention. Other operations, orders of operations and embodiments are also within the scope of the present invention.

The method of controlling the washing machine shown in FIG. 14 may be similar to the method of FIG. 13. In other words, operations S1415, S1420, S1430 and S1425 between a laundry amount sensing operation S1410 and the stop or deceleration operation S1435 may be similar to operations in FIG. 13. A redundant description thereof may be omitted for simplicity.

Additionally, after the stop or deceleration operation S1435, the controller 210 may increase the rotational speed of the drum 122 to the first speed V1 in operation S1440. At this time, a first speed rising slope may be changed to improve balancing of laundry.

The controller 210 may control the drum 122 to operate at the first speed V1 again in operation S1445.

The controller 210 may then determine in operation S1450 whether an unbalance amount of the drum 122, which is sensed during the first speed V1 operation, is the second specific value or less. If the unbalance amount of the drum 122 in operation S1450 is determined to be the second specific value or less, the controller 210 may increase the rotational speed of the drum 122 to the second speed V2 in operation S1455. At this time, the second speed V2 rising slope may be changed to improve balancing of laundry. The controller 210 may then control the drum 122 to operate at the second speed V2 in operation S1460.

Figure 15:
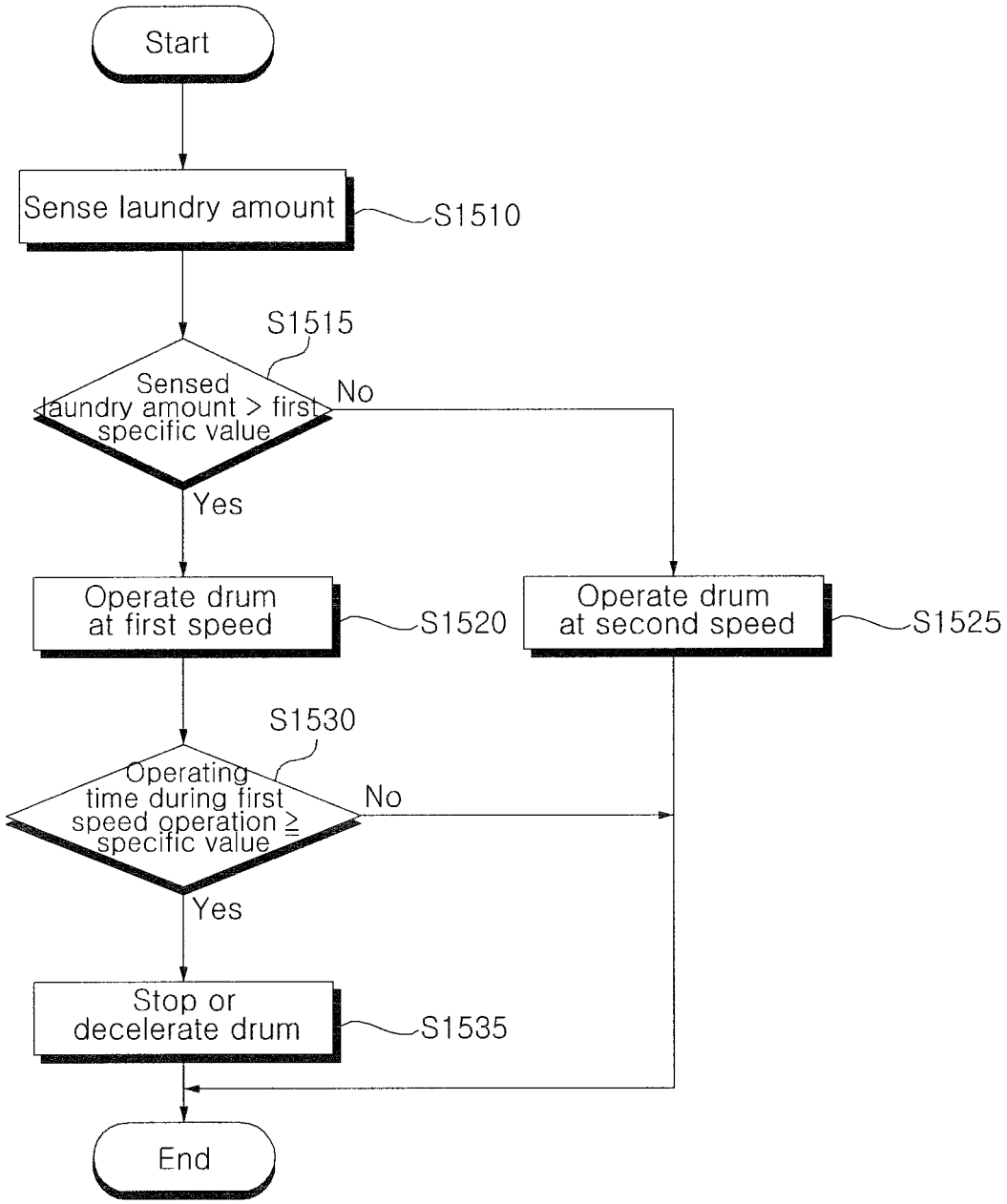
FIG. 15 is a flowchart illustrating a method of controlling a washing machine in accordance with an example embodiment of the present invention.

FIG. 15 is a flowchart illustrating a method of controlling a washing machine in accordance with an example embodiment of the present invention. Other operations, orders of operations and embodiments are also within the scope of the present invention.

The control method of FIG. 15 may be similar or identical to the method of FIG. 13 except that FIG. 15 determines in operation S1530 whether an operating time during a first speed operation is a specific time or greater. The drum 122 may be stopped or decelerated according to a result of the determination in operation S1535. A redundant description will be omitted for simplicity.

Figure 16:
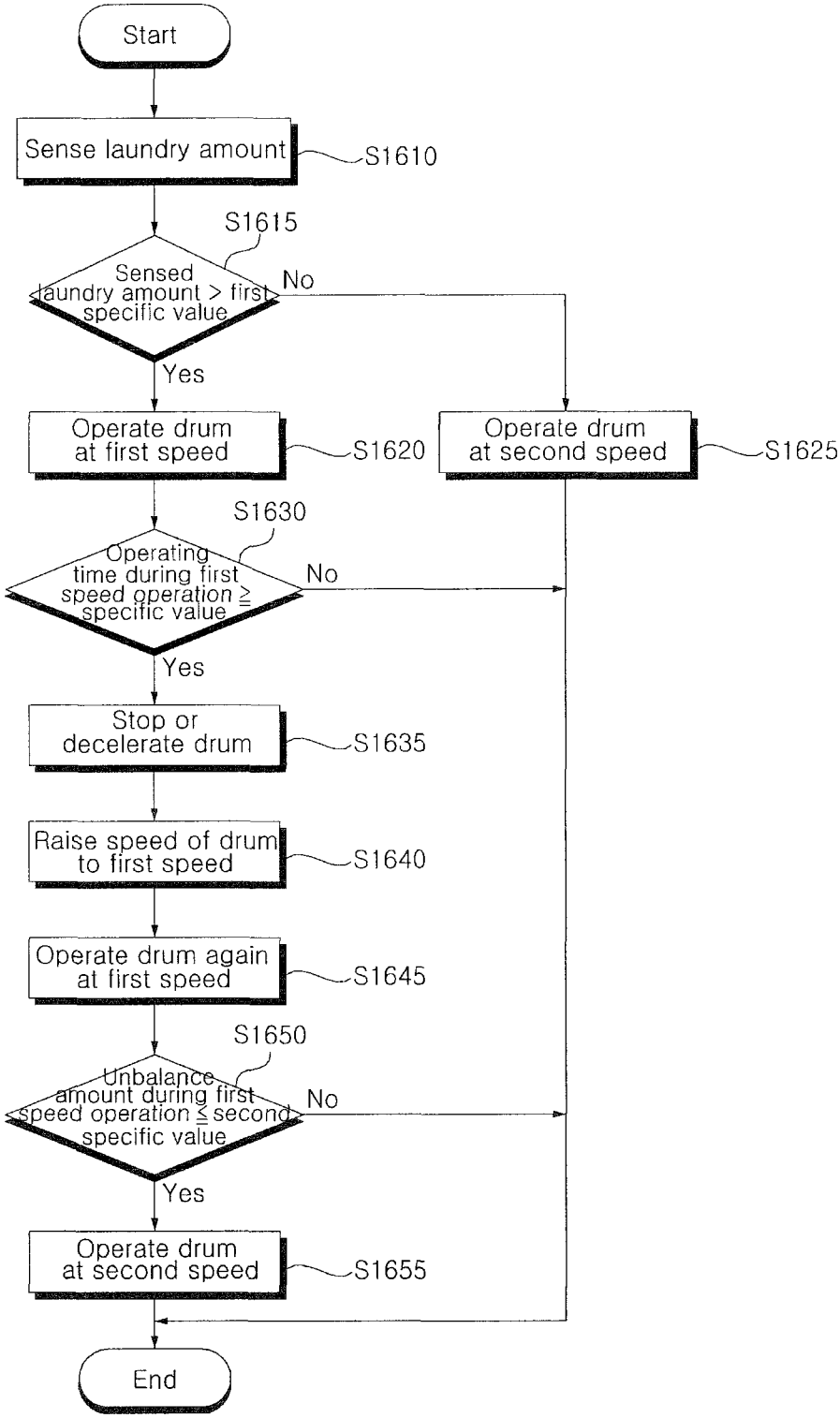
FIG. 16 is a flowchart illustrating a method of controlling a washing machine in accordance with an example embodiment of the present invention.

FIG. 16 is a flowchart illustrating a method of controlling a washing machine in accordance with an example embodiment of the present invention. Other operations, orders of operations and embodiments are also within the scope of the present invention.

The control method of FIG. 16 may be similar or identical to the method of FIG. 14 except that FIG. 16 determines in operation S1630 whether an operating time during a first speed operation is a specific time or greater. The drum 122 may be stopped or decelerated according to a result of the determination. A redundant description of FIG. 16 will be omitted for simplicity.

The method of controlling the washing machine in accordance with embodiments of the present invention may be implemented as a processor-readable code in a recording medium that can be read by a processor equipped in a washing machine. The processor-readable recording medium may include all kinds of recording devices in which data readable by a processor is stored. For example, the processor-readable recording medium may include ROM, RAM, CD-ROM, magnetic tapes, floppy disks, optical data storages, and so on, and may also be implemented in the form of carrier waves, such as transmission over the Internet. Further, the processor-readable recording medium may be distributed into computer systems connected over a network, so codes readable by a processor can be stored and executed in a distributed manner.

In accordance with an embodiment of the present invention, an operation speed may be decided according to a laundry amount. Accordingly, balancing of laundry can be improved efficiently.

An unbalance amount of the drum when the rotational speed of the drum increases to a second speed, an unbalance amount of the drum during a first speed operation or a first speed operation period may be determined. When an abnormality occurs, the drum may stop or decelerate immediately. Accordingly, at a time of the dehydration cycle, stability of a washing machine and balancing of laundry may be ensured.

In addition, the drum may be driven at a first speed at which part of laundry tumbles so as to meet a balancing state of the laundry to some extent, and not at a speed at which the entire laundry tumbles as in disadvantageous arrangements. The drum 122 may then rotate at a second speed. Accordingly, laundry may be distributed accurately and rapidly.

An embodiment of the present invention may provide a washing machine having improved stability and improved laundry balancing at a time of a dehydration cycle.

An embodiment of the present invention may provide a method of controlling a washing machine including a drum in which laundry are entered and rotated. The method may include sensing a laundry amount, and when the sensed laundry amount exceeds a first specific value, operating the drum at a first speed so that part of the laundry tumbles within the drum and another part of the laundry adheres to the drum. When the sensed laundry amount is the first specific value or less, the drum may operate at a second speed so that the laundry adheres to the drum.

An embodiment of the present invention may provide a washing machine including a drum in which laundry are entered and rotated, a laundry amount sensor for sensing an amount of the laundry within the drum, and a controller for controlling the drum to operate at a first speed when the sensed laundry amount exceeds a first specific value so that part of the laundry tumbles within the drum and another part of the laundry adheres to the drum, and the controller controlling the drum to operate at a second speed when the sensed laundry amount is the first specific value or less so that the laundry adheres within the drum.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a washing machine that includes a drum, the method comprising:

sensing an amount of laundry;

comparing the sensed laundry amount to a first specific value; and operating the drum based on a result of the comparison, wherein said operating includes:

(a) operating the drum at a first speed so that a first part of the laundry tumbles within the drum and a second part of the laundry adheres to the drum, wherein the drum is operated at the first speed at a point in time which corresponds to when the sensed laundry amount exceeds the first specific value, said operating the drum at the first speed further including maintaining the drum at substantially the first speed for a first time period, wherein the first speed corresponds to a speed that causes the second part of the laundry to adhere to the drum at a location where the second part of the laundry reaches substantially an uppermost point during rotation of the drum, and (b) operating the drum to increase from the first speed to a second speed, wherein substantially all the laundry adheres to the drum at the second speed, wherein the first time period is greater than zero, and wherein (a) and (b) are performed after a laundry loose operation.

2. The method of claim 1, further comprising increasing a rotational speed of the drum from the first speed to the second speed when a detected unbalance amount of the drum is a second specific value or less.

3. The method of claim 2, further comprising decelerating rotation of the drum when a detected unbalance amount of the drum is a third specific value or greater.

4. The method of claim 3, further comprising rotating the drum at the first speed for a second time after decelerating the rotation.

5. The method of claim 4, wherein after rotating the drum at the first speed for a second time, the method further comprises:

increasing the rotational speed of the drum to the second speed; and operating the drum at the second speed.

6. The method of claim 5, wherein the rotational speed of the drum is increased from the first speed to the second speed for the second time at a rate different from a first time the rotational speed of the drum is increased from the first speed to the second speed.

7. The method of claim 1, further comprising decelerating the rotation of the drum when an operation period of the first speed is a specific time or greater.

8. The method of claim 1, further comprising decelerating the rotation of the drum when an unbalance amount of the drum detected while the drum is operating at the first speed is a second specific value or greater.

9. The method of claim 8, further comprising rotating the drum at the first speed after decelerating the rotation.

10. The method of claim 1, further comprising:

detecting an amount of unbalance of the laundry in the drum; and operating the drum at a third speed to reduce the amount of detected imbalance.

11. The method of claim 10, wherein the third speed is greater than zero and less than the second speed.

12. The method of claim 10, wherein the third speed is zero.

13. The method of claim 10, further comprising:

operating the drum at a fourth speed after the third speed; and increasing the speed of the drum from the fourth speed to a fifth speed, wherein the fourth speed is substantially equal to the first speed and the fifth speed is substantially equal to or greater than the second speed.

14. The method of claim 13, wherein the speed of the drum is increased from the fourth speed to the fifth speed at a rate different from a rate at which the speed of the drum is increased from the first speed to the second speed.

15. The method of claim 1, further comprising:

operating the drum without performing (a) at a second speed when the sensed laundry amount is less than the first specific value.

* * * * *